US007866265B1

(12) United States Patent
Kravel et al.

(10) Patent No.: US 7,866,265 B1
(45) Date of Patent: Jan. 11, 2011

(54) FLARE APPARATUS

(76) Inventors: Jacob Kravel, 226 Newtown Rd., Plainview, NY (US) 11803; Michael Brunn, 226 Newtown Rd., Plainview, NY (US) 11803

( * ) Notice: Subject to any disclaimer, the term of this patent is extended or adjusted under 35 U.S.C. 154(b) by 661 days.

(21) Appl. No.: 11/770,914

(22) Filed: Jun. 29, 2007

Related U.S. Application Data

(60) Provisional application No. 60/806,267, filed on Jun. 30, 2006.

(51) Int. Cl.
*F42B 4/26* (2006.01)

(52) U.S. Cl. ..... 102/336

(58) Field of Classification Search ..... 102/336, 102/338, 345, 346
See application file for complete search history.

(56) References Cited

U.S. PATENT DOCUMENTS 1,641,549 A * 9/1927 Paulus et al. ..... 102/346
1,754,987 A * 4/1930 Driggs, Jr. et al. ..... 102/346
2,381,130 A * 8/1945 Lloyd ..... 89/1.1
3,323,456 A * 6/1967 Rothman ..... 102/346
3,349,707 A * 10/1967 Wortley, Jr. et al. ..... 102/346
3,431,852 A * 3/1969 Fowler ..... 102/334
3,457,860 A * 7/1969 Allen ..... 102/346
3,587,468 A * 6/1971 Bliss ..... 102/346
3,611,935 A * 10/1971 Beckes et al. ..... 102/346
3,760,729 A * 9/1973 Freeman ..... 102/346
3,855,930 A * 12/1974 Mulich et al. ..... 102/342
3,913,482 A * 10/1975 Schiessl et al. ..... 102/346
3,981,241 A * 9/1976 Ambrosini et al. ..... 102/346
4,013,009 A * 3/1977 Claude et al. ..... 102/339
4,457,233 A * 7/1984 Hyde ..... 102/346
4,768,439 A 9/1988 Singer et al.
6,092,467 A * 7/2000 Brice ..... 102/336
6,263,797 B1 * 7/2001 Brice ..... 102/346

* cited by examiner

*Primary Examiner*—Bret Hayes
(74) *Attorney, Agent, or Firm*—Bennet K. Langlotz; Langlotz Patent & Trademark Works, Inc.

(57) ABSTRACT

A flare apparatus constructed of a flare case with a primer functionally coupled to a propellant charge. Loaded within the flare case is a flare cup, having within, a starter composition, a flare composition, and a flash charge. The flare composition is functionally coupled to the flare starter composition, and the flash charge is functionally coupled to the flare composition. Upon primer activation the propellant charge is ignited. Flame and hot gasses from the propellant charge propel the flare cup out of the flare case and downrange while also igniting the flare starter composition within the flare cup. The flare starter composition ignites the flare composition, which produces a visual artifact and subsequently ignites the flash charge which produces a visual and audible artifact at or near the end of its flight.

3 Claims, 4 Drawing Sheets

FLARE APPARATUS

This application claims benefit of U.S. Provisional Application Ser. No. 60/806,267 filed Jun. 30, 2006.

FIELD OF THE INVENTION

The present invention is related to the field of signaling flares.

SUMMARY OF THE DESCRIPTION

The present flare apparatus comprises a flare case having a primer functionally coupled to a propellant charge. Loaded within the flare case is a flare cup, having within, a starter composition, a flare composition, and a flash charge. The flare composition is functionally coupled to the starter composition and the flash charge that is functionally coupled to the flare composition. Upon primer activation the propellant charge is ignited. Flame and hot gasses from the propellant charge forcefully expell the flare cup out of the flare case and downrange while also igniting the flare starter composition within the flare cup. The flare starter composition ignites the flare composition, which produces a visual artifact and subsequently ignites the flash charge which produces a visual and audible effect at or near the end of its flight.

DISCUSSION OF EMBODIMENT(S)

Figure 4A:
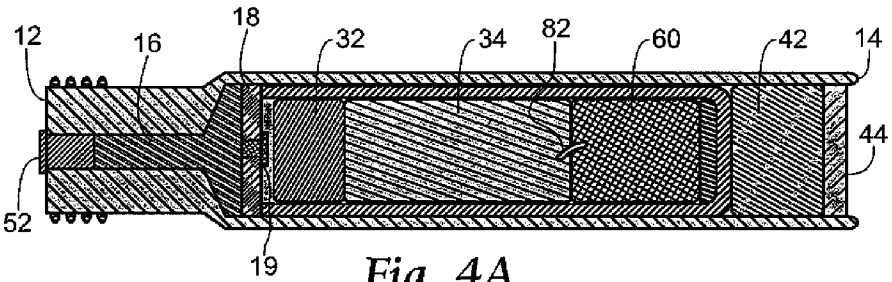
FIG. 4A illustrates an assembled flare apparatus.

FIG. 4 illustrates one possible embodiment of the assembled flare apparatus. The embodiment illustrated and described herein is characterized by its assembly and composition and the sensory characteristics associated with the operation of the flare apparatus. Further, despite that military standards are referred to in the description, the invention should not be construed to be limited to any particular military specification or the dimensional specifications associated therewith.

The flare apparatus generally comprises a propellant charge within a flare case that propels a flare cup downrange. The flare cup includes a relatively slow burning pyrotechnic flare composition and a rapidly consumed flash charge. Ignition of the flare apparatus ignites the propellant charge which propels the flare cup out of the flare case and downrange towards a target or destination while also igniting the pyrotechnic flare composition. The ignited pyrotechnic flare composition produces a visual artifact for the intermediate portion of the flight of the flare cup downrange towards its destination or target. The subsequently ignited flash charge produces an auditory and visual artifact at or near the end of the flight of the flare cup downrange towards the destination or target. One possible embodiment of a flare apparatus in accordance with the present description is shown in the figures.

Figure 2A:
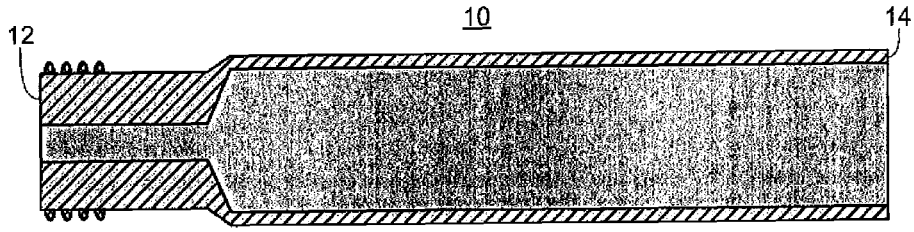
FIG. 2A illustrates a side cut-away view of one embodiment of the flare case described herein.

Referring first to FIG. 2A, a flare case 10 is preferably made of substantially rigid material and includes a first end 12 and a second end 14. The first end 12 has an opening that is adapted or sized to receive a primer 52 positioned in the first end 12 such that the striking surface of the primer 52 is exposed at the first end 12 of the flare case 10. The flare case 10 embodiment illustrated in FIG. 2A comprises a generally cylindrical exterior peripheral surface 13 comprising at least two portions; a first portion having a smaller circumferential perimeter relative to the circumferential perimeter of a second portion. The first portion is associated with the first end 12 and the second portion is associated with the second end 14. This particular flare case 10 interior chamber comprises a tapered interior portion resembling a truncated conical cross-section configuration adjacent to the transition between the flare case 10 first portion and second portion. The narrowing of the truncated conical cross-section is oriented towards the first end 12. A first substantially cylindrical primer manifold or passage extends from the truncated conical cross-section narrowing to the first end 12 of the flare case 10. The truncated conical cross-section widening is oriented towards the second end 14 and located adjacent the transition between the flare case 10 first portion and second portion. A substantially cylindrical interior chamber portion extends from the widening of the truncated conical cross-section to the second end 14 of the flare case.

Figure 2B:
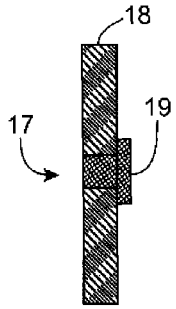
FIG. 2B illustrates a propellant charge plug with a manifold and a tab covering the manifold.
Figure 2C:
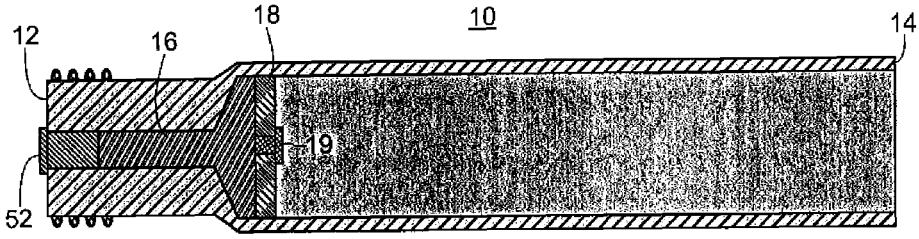
FIG. 2C illustrates a flare case with a propellant charge and a propellant charge plug loaded into the flare case.

The first end 12 opening is sized to receive a primer 52 oriented such that the activation of the primer causes the combustion gases to be directed towards the widening of the truncated conical cross-section and the substantially cylindrical interior chamber portion of the flare case 10. See FIG. 2C. Moreover, loaded within the flare case 10 at or near the primer manifold and the truncated conical cross-section widening is a propellant charge 16. See FIG. 2C. The propellant charge 16 is functionally coupled to the primer 52 and preferably comprised of black powder. Ignition of the primer 52 causes fire and hot gasses to pass through the primer manifold, which in turn ignites the propellant charge 16. The confined combustion of the propellant charge 16 within the flare case 10 causes hot gasses to build and ultimately forcefully expel the contents of the flare case 10. The propellant charge 16 is secured in the flare case 10 to facilitate the building of pressure within the flare case 10. A plug or wad may secure the propellant charge 16 in the flare case 10. Moreover, since the combustion of the propellant charge 16 also ignites the flare composition in the flare cup 20, the preferred plug or wad includes at least one manifold or passage through which fire or hot gas from the burning propellant charge 16 may pass to ignite the flare composition. FIG. 2B illustrates a propellant charge plug 18 having at least one manifold 17 in the propellant charge plug 18 wall. A further preference is a tab 19 that covers the manifold 17 and secures the propellant charge 16 but which is compromised by the fire and pressure of the burning propellant charge 16. Preferred plug 18 materials comprise paper, plastic, cardboard, fabric, wax, and epoxy. Preferred tab 19 materials include wax, paper, and plastics such as tapes.

Figure 1:
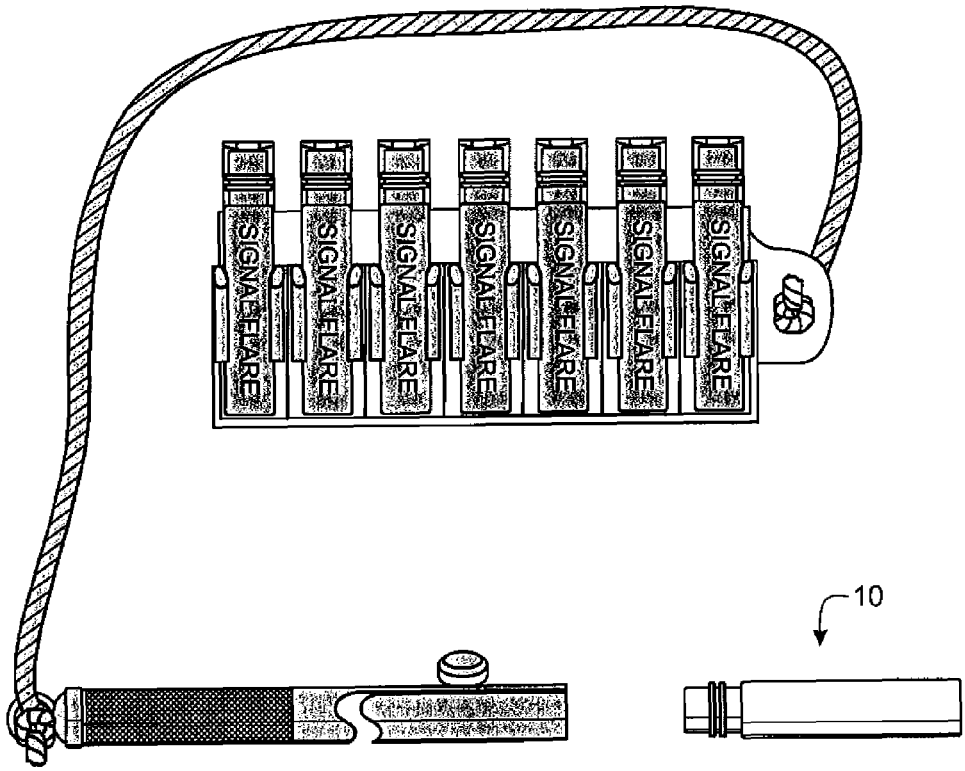
Fig. 1 (prior art)
FIG. 1 illustrates a kit for use with one embodiment of the flare apparatus described herein.
Figure 2D:
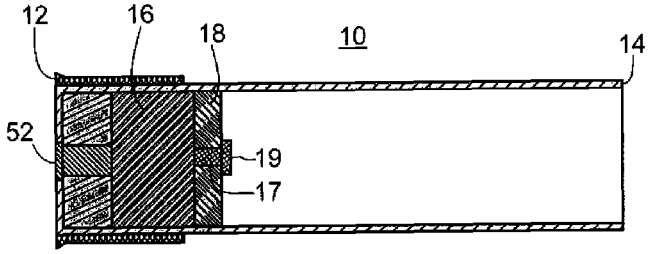
FIG. 2D illustrates a flare case with a propellant charge and a propellant charge plug loaded into the flare case and having a structure that is scalable to 12-gauge, 37 mm, and 40 mm weapon shells.

For the illustrated embodiment, the flare case dimensions are consistent with military specifications for the MK 80 Mod 0 or hand fired "pen" signal flare shown in FIG. 1. The flare apparatus disclosed herein is also applicable to alternately sized flare cases and common weapon calibers. Alternate embodiments include weapon fired flare apparatus embodying the visual and auditory effects commensurate with the current description. For instance, the flare apparatus disclosed herein is adaptable to 12-gauge, 37 mm and 40 mm arms. FIG. 2D illustrates a flare case 10 structure that is scalable to be dimensionally compatible with weapon shells for 12-gauge, 37 mm, and 40 mm arms for associated flare apparatus use. The dimensions of a flare case suitable for use with a 37 mm weapon of three and one-half inches with the propellant charge in place and a flare case diameter of approximately one and one-half inches. The 40 mm weapon shell similarly has a flare case length of three and one-half inches, not including the propellant charge, and a slightly larger diameter. The 12-gauge flare apparatus has a flare case length of two and one-sixteenth inches and a diameter of three-eighths of an inch.

Figure 3A:
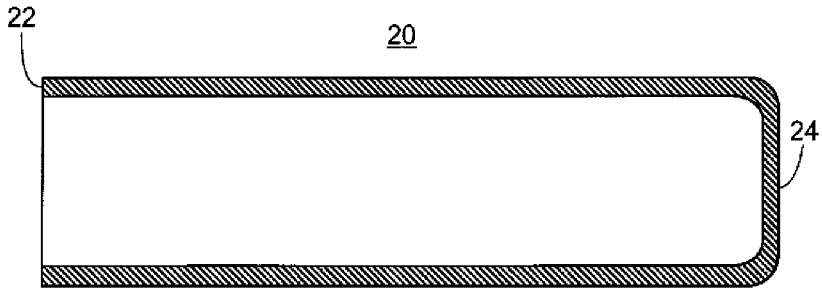
FIG. 3A illustrates a side cut-away view of a flare cup.

Referring now to the flare cup 20, an embodiment of which is, illustrated in FIG. 3*a*. The flare cup 20 is sized for receipt or loading into the open second end 14 of the flare case 10 and comprises a tubular construction having a closed end and an open end. The preferred flare cup 20 has a generally cylindrical peripheral surface that extends between, and that is terminated by, an open end 22 and a closed end 24. The flare cup 20 cylindrical peripheral outer surface aligns adjacent to the cylindrical interior chamber portion of the flare case 10 when it is loaded or received into the flare case 10. It is considered within the knowledge of a person having ordinary skill in the art to adapt the teachings herein to construct the flare cups for alternate standard and non standard caliber weapon shells.

A flare composition is loaded into the flare cup 20, which when ignited, produces a visual artifact such as smoke or light. Flare compositions vary according to the circumstances and desired performance. Preferred flare compositions include a first fire or flare starter composition and a visual flare composition and may include one more of the following components:

MAGNESIUM POWDER SIGNAL TYPE-3 GRAIN 15

BARIUM NITRATE GR-A CL-6 (MIL-B-162)

STRONTIUM NITRATE GR-A (MIL-S-20322)

POTASSIUM PERCHLORATE GR A CL 4 (MIL-P-217)

POLYVINYL CHLORIDE (MIL-P-20307)

LUPERSOL DDM (CADOX M 50A)

LAMINAC 4110 SPEC #505-004

ACETONE TECHNICAL

COPPER METAL POWDER (MIL-C-768)

The flash charge 80 is also loaded into the flare cup 20 and functionally coupled to the flare composition. The flash charge 80 preferably comprises a volume or quantity of a combustible composition that will produce sufficient combustion gasses to compromise the flare cup 20 and produce a visual flash and an audible report. A flash charge 80 generally comprises at least one component selected from the group consisting at least of an aerosol and a combustible. Preferential flash charge 80 components include but are not limited to black powder, potassium perchlorate, and a flake or powdered metal such as aluminum.

Figure 3B:
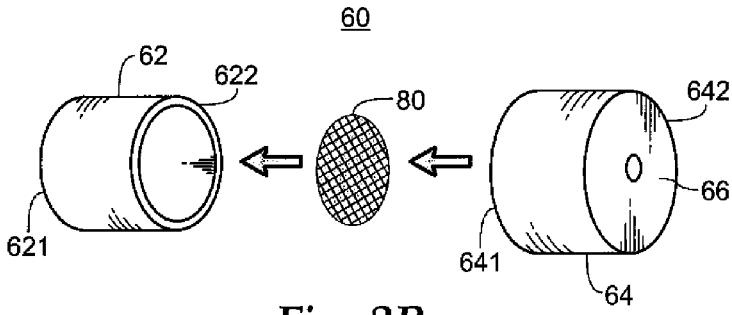
FIGS. 3B and 3C illustrate a charge cup assembly.
Figure 3C:
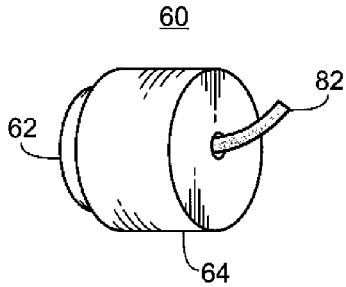

The preferred manner of loading the flash charge 80 into the flare cup 20 includes confining the flash charge 80 within a charge cup 60. Depending on the particular embodiment or caliber of arm selected, an appropriately sized charge cup 60 is loaded into the second end 22 opening of the flare cup 20 prior to the flare composition. The charge cup 60 substantially confines the flash charge 80 and comprises any material that can withstand the heat and pressure of the adjacently consumed flare composition 34, but that eventually yields to the expansion forces of the combustion gases associated with the flash charge 80 consumption to produce a significant audible report sufficient to startle a person and be heard on a battlefield. One embodiment of a charge cup 60 comprises an outer cup 64 adapted or sized to mate with an inner cup 62. See FIGS. 3*b* and 3*c*. The outer cup 64 has a generally cylindrical peripheral surface that extends between, and that is terminated by, an open first end 641 and a substantially closed second end 642. The second end 642 has a fuse aperture 66 through which a fuse is received substantially perpendicular to the second end 642. Orientation of the fuse 82 as described facilitates coupling the fuse 82 to the flare composition. The inner cup 62 has a generally cylindrical peripheral surface that extends between, and that is terminated by, an open first end 622 and a closed second end 621. Preferred dimensions of the illustrated charge cup 60 have a volume within the range of 0.06-0.6 ounces. Finally, while a cylindrically shaped charge cup 60 is described, it is also contemplated that alternately shaped charge cups would also effectively encapsulate the desired flash charge 80 and permit functional coupling with the flare composition.

To assemble the flare apparatus, the flash charge 80 is loaded into the inner cup 62 and the outer cup 64 is joined thereto, such as by an adhesive or using a mechanical means. See FIG. 3*b*. The flash charge 80 preferably comprises a volume or quantity of a combustible composition that will produce sufficient combustion gasses and coincidentally compromise the charge cup 60 to produce a visual flash and an audible report. A flash charge 80 generally comprises at least one component selected from the group consisting at least of an aerosol and a combustible. Preferential flash charge 80 components include but are not limited to black powder, potassium perchlorate, and a flake or powdered metal such as aluminum. To complete the charge cup 60, a fuse 82 is functionally coupled to the flash charge 80 by insertion into the fuse aperture 66 in the charge cup 60. See FIG. 3*c*. A preferred fuse is flexible and water repellant, though the selection or construction of an appropriate fuse is contemplated to be within the skill of an ordinarily skilled practitioner in light of this description.

Figure 3D:
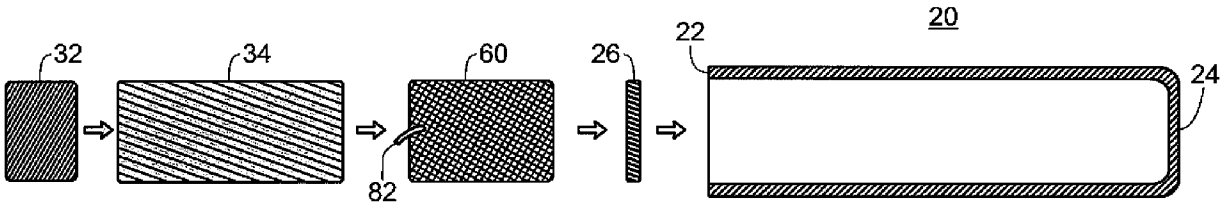
FIG. 3D illustrates the preferred loading sequence of the flare cup.

FIG. 3*d* illustrates a preferred loading sequence of the flare cup 20 components. Optional, but preferred, ballast 26 is loaded into the flare cup 20 to assume a position adjacent to or against the closed end 24 of the flare cup 20. The ballast 90 comprises sufficient weight to promote stabilization and deter tumbling of the flare cup 20 in flight. The ballast 90 also lessens the likelihood that crosswind will direct the flare cup 20 away from its aimed trajectory. The actual weight sufficient to stabilize the flare cup 20 in flight will vary depending on the particular embodiment of the flare assembly but will likely be approximately between one and ten grams for the hand held signal flare, and between five and fifteen grams for the 12-gauge and the 37 mm and 40 mm flare embodiments. Exemplary ballast 26 materials include metallic, ceramic, or plastic materials including as lead or lead shot, glass beads, and epoxy or resin. Alternatively, the ballast 90 could be integrated into a wall of the flare cup 20.

At least one charge cup 60 is loaded into the open first end 22 of the flare cup 20 and positioned adjacent to the closed second end 24 or the ballast 26 if it is included as illustrated. A flare composition 34 and a flare starter composition 32 are loaded into the open first end 22 of the flare cup 20 and compressed against the charge cup 60 to compact flare composition 34 and functionally couple the flare composition 34 to the fuse 82. The flare composition may be further secured in place within the flare cup 20 in a manner ordinary for signal flares. Finally, the assembled flare cup 20 is loaded into the flare case 10 and cloth or equivalent spacer(s) 42 can be used to promote a snug fit of the flare cup 20 within the flare case 10. See FIG. 4. A flare case cap 44 secures flare cup 20 in the flare case 10, seals the flare case 10 compartment to the outside elements, and the completes the flare apparatus assembly The assembled flare apparatus is used by placing it in a flare launcher, for example, of conventional design shown in FIG. 1. The primer is struck which results in the primer 52 exploding. The primer explosion creates fire and hot gases in the interior chamber of the flare case 10, which ignites the propellant charge 16. As the propellant charge 16 is consumed, fire and hot gas build in the space confined by the propellant charge plug 18. The tab 19 covering the manifold 17 in the propellant charge plug 18 eventually yields to the building pressure of the burning propellant charge 16 thereby igniting the flare starter composition 32 and ultimately forcefully expelling the ignited flare cup 20 downrange towards its target. The ignited flare starter composition 32 subsequently lights the flare composition 34 in the flare cup 20, which burns with sufficient intensity provide a visual artifact such as light or smoke. Finally, when the flare composition 34 has been substantially consumed, the fuse 82 and flash charge 80 are ignited in turn and produce a visual flash and an audible report.

A preferred use of the flare apparatus includes firing the flare apparatus in the direction, but not necessarily at, an approaching individual or entity to signal or convey information to the approaching individual or entity. Thus, rather than fired substantially vertically as with most signal flares, the present apparatus is fired substantially horizontally and in the direction of a known entity. The apparatus therefore signals or conveys information generally including at least a notice that the entity that fired the flare is present. By conveyance of the fact that the flare operator is present, the flare operator and approaching individual or entity can engage in further communications or assess and plan further advancement or retreat.

Although the invention has been described in detail with reference to one or more particular preferred embodiments, persons possessing ordinary skill in the art to which this invention pertains will appreciate that various modifications and enhancements may be made without departing from the spirit and scope of the claims that follow.

What is claimed is:

1. A flare apparatus comprising:

a flare case having a primer functionally coupled to a propellant charge;

a flare cup loaded within the flare case, and the flare cup having a flare composition and a flash charge loaded therein, the flare composition functionally coupled to the propellant charge, and the flash charge functionally coupled to the flare composition;

wherein the propellant charge is confined by a propellant charge plug;

wherein the propellant charge plug has a wall with a manifold; and wherein the manifold is covered by a tab having less structural strength than the wall of the propellant charge plug.

2. A flare apparatus, comprising:

a flare case including a propellant charge confined by a propellant charge plug and functionally coupled to an ignition device;

a flare cup positioned inside the flare case, the flare cup comprising a confinement for a flare composition that is functionally coupled to the propellant charge;

a flash cup positioned in the flare cup, the flash cup comprising a confinement for a flash charge that is functionally coupled to the flare composition; and wherein the flash cup comprises a confinement structure having a fuse aperture, and a fuse positioned in the fuse aperture and contacting the flash charge and the flare composition.

3. The flare apparatus in claim 2 wherein, the confinement structure comprises at least two portions which are manipulated to provide access to a compartment for receipt of the flash charge.

* * * * *